US006436301B1

(12) United States Patent
Hiroki et al.

(10) Patent No.: US 6,436,301 B1
(45) Date of Patent: Aug. 20, 2002

(54) METHOD FOR MANUFACTURING A LIQUID DISCHARGE HEAD

(75) Inventors: Tomoyuki Hiroki, Zama; Takayuki Yagi; Teruo Ozaki, both of Yokohama; Masahiko Kubota, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/291,035

(22) Filed: Apr. 14, 1999

(30) Foreign Application Priority Data

Apr. 16, 1998 (JP) ..... 10-106297
Apr. 7, 1999 (JP) ..... 11-099872

(51) Int. Cl.[7] ..... B41J 2/04

(52) U.S. Cl. ..... 216/27; 438/21; 347/56; 347/65

(58) Field of Search ..... 216/27; 438/21; 347/56, 65

(56) References Cited

U.S. PATENT DOCUMENTS 4,480,259 A * 10/1984 Kruger et al. ..... 347/54
5,177,579 A * 1/1993 Jerman ..... 73/724
5,825,383 A * 10/1998 Abe et al. ..... 347/54

FOREIGN PATENT DOCUMENTS

EP 0 816 083 A2 1/1998
JP 61-59911 B2 5/1979
JP 61-59914 B2 2/1980
JP 55-81172 6/1980
JP 59-26270 2/1984
JP 4-329148 11/1992
JP 5-229122 9/1993

OTHER PUBLICATIONS

Patent Abstracts of Japan, vol. 017, No. 168 (M–1391), Mar. 31, 1993 (wth respect to JP 4–329148 of Nov. 17, 1992).

* cited by examiner

*Primary Examiner*—Randy Gulakowski
*Assistant Examiner*—Shamim Ahmed
(74) *Attorney, Agent, or Firm*—Fitzpatrick, Cella, Harper & Scinto

(57) ABSTRACT

A method for manufacturing a liquid discharge head, which is provided with a movable film supporting member for supporting a movable film separating a first liquid flow path and a bubble creation region completely, and that is displaceable by the bubble created on the heat generating element. The method comprises the steps of forming the movable film supporting member, forming on the surface of the substrate becoming the movable film supporting member the recessed portion corresponding to the movable region of the movable film, providing a material becoming the movable film on the entire surface of the substrate having the recessed portion provided therefor, removing the portion including the movable region on the substrate from the reverse side of the substrate having the movable film provided therefor and forming a slacked configuration on the portion of the movable region of the movable film.

10 Claims, 10 Drawing Sheets

METHOD FOR MANUFACTURING A LIQUID DISCHARGE HEAD

BACKGROUND OF THE INVENTION

1. Field of the Invention

The present invention relates to a method for manufacturing a liquid discharge head which discharges a desired liquid with the creation of bubbles by the application of thermal energy or the like. More particularly, the invention relates to a method for manufacturing a liquid discharge head that uses movable separation film displaceable by the utilization of the creation of bubbles.

In this respect, the term "recording" referred to in the description of the present invention not only means the provision of meaningful images, such as characters, graphics, on a recording medium, but also, means the provision of meaningless images, such as patterns on it.

2. Related Background Art

There has been known conventionally the ink jet recording method, that is, the so-called bubble jet recording method, in which by the application of thermal energy or the like to ink, the abrupt change of its states is generated with the resultant voluminal changes in ink (the creation of bubbles), and then, ink is discharged from the discharge ports by the acting force based upon this change of states, thus enabling ink to adhere to a recording medium for the image formation. As disclosed in Japanese Patent Publication Nos. 61-59911 and 61-59914, in general, the recording apparatus using this bubble jet recording method comprises discharge ports that discharge ink; ink flow paths communicated with the discharge ports; and heat generating members (electrothermal converting means) arranged in the ink flow paths, respectively, to function as means for generating energy used for discharging ink.

By use of the recording method described above, it is possible to record high quality images at high speeds with a lesser amount of noises. At the same time, this method enables the discharge ports to be arranged in high density for discharging ink, thus making it possible to record images in high resolution with a smaller apparatus. Moreover, there are many advantages, such as to make it easier to obtain color images. As a result, the bubble jet recording method has been utilized widely in recent years for the office equipment, such as a printer, a copying machine, a facsimile apparatus. This method has also been utilized for the industrial system, such as textile printing apparatus.

On the other hand, for the-conventional bubble jet recording method, there is encountered the problem of the burnt ink accumulation on the surface of the heat generating members in some case, because the heat generating members are repeatedly heated while in the state of being in contact with ink. Also, if the liquid that should be discharged tends to be easily deteriorated by the application of heat or if the liquid is the one for which the bubbling capability cannot be obtained sufficiently, it becomes difficult to perform discharges in good condition in some cases by the adoption of the direct heating method for creating bubbles by use of the heat generating members described earlier.

Under the circumstances, the applicant hereof has proposed a method whereby to discharge the discharging liquid by foaming the bubbling liquid by the application of thermal energy through flexible films each arranged to separate the bubbling and discharging liquids as disclosed in the specification of Japanese Patent Application Laid-Open No. 55-81172. For this method, the structure of the flexible films and the bubbling liquid is arranged so that each of the flexible films is installed on the part of each nozzle. Further, in the specification of Japanese Patent Application Laid-Open No. 59-26270, there has been disclosed the structure in which a large film is used to separate the entire head body into the upper and lower portions. This large film is pinched by two plate members that form the liquid paths. This film is provided for the purpose of preventing liquids in the two liquid paths from being mixed with each other.

Meanwhile, in the specification of Japanese Patent Application Laid-Open No. 05-229122, there has been disclosed the method in which the bubbling liquid itself is characterized and its bubbling property is made to present a lower boiling point than the discharging liquid to be used or in the specification of Japanese Patent Application Laid-Open No. 04-329148, there has been disclosed the one whereby to use the liquid having conductivity as the bubbling liquid.

However, the liquid discharge method that uses the conventional separation films as described above is just structured to separate the bubbling liquid and the discharging liquid or just to improve the property of the bubbling liquid itself. Thus, non of them have reached the practical standard as yet.

The inventors hereof have ardently studied on the liquid droplet discharge that uses the separation films centering on the phenomena of the discharge liquid droplets, and have reached the conclusion that the efficiency of the liquid discharges with the bubble formation by the application of thermal energy tends to be lowered when the discharges are effectuated through the intervention of the changing separation films, and that this inefficiency impedes the method from being used practically as yet.

Therefore, the inventors hereof have further studied on the provision of the liquid discharge method and apparatus with which they can attain the higher standard of liquid discharges, while keeping the effect of the intended function of the separation film as it is.

SUMMARY OF THE INVENTION

During such studies, the inventors hereof have designed the present invention that provides an epoch-making liquid discharge head capable of enhancing the discharge efficiency of the liquid droplet discharges, as well as capable of stabilizing and increasing the volume of the discharge liquid droplets or discharge speeds. The invention also provides the method of manufacture therefor.

It is a first object of the invention to provide a method for manufacturing liquid discharge heads with a simpler method in good precision, which is capable of manufacturing a liquid discharge head structured to be able to substantially separate the discharging liquid and the bubbling liquid by use of the movable film, or more preferably, structured to be able to separate them completely by use of thereof.

It is a second object of the invention to provide a method for manufacturing a liquid discharge head capable of obtaining higher discharge power without spoiling the discharge efficiency with the structure described above, which is not only capable of preventing the pressure from escaping to the upstream side, but also, capable of guiding the pressure in the direction of the discharge ports.

Also, it is a third object of the invention to provide a method for manufacturing a liquid discharge head capable of reducing the amount of the substance accumulated on the heat generating elements (members) due to the structure formed as described above, at the same time being able to discharge liquid with a good efficiency, but not to exert the thermal influence on the liquid to be discharged.

Also, it is a fourth object of the invention to provide a method for manufacturing a liquid discharge head having a wider freedom of liquid selections irrespective of the viscosity or the material composition of the liquid to be discharged.

In order to achieve the objects described above, the method of the present invention for manufacturing a liquid discharge head, which is provided with a discharge port for discharging a liquid droplet; a first liquid flow path for supplying discharging liquid to the discharge port; a second liquid flow path for bubbling liquid supplied thereto; a heat generating element for the formation of a bubble creation region arranged for the second liquid flow path; a movable film supporting member for supporting the movable film separating the first liquid flow path and the bubble creation region completely, and being displaceable by the bubble created on the heat generating elements; and discharging a liquid droplet from the discharge port by the utilization of thermal energy provided by the heat generating elements, comprises the steps of forming the movable film supporting member; forming on the surface of the substrate becoming the movable film supporting member the recessed portion corresponding to the movable region of the movable film; providing a material becoming the movable film on the entire surface of the substrate having the recessed portion provided therefor; removing the portion including the movable region on the substrate from the reverse side of the substrate having the movable film provided therefor; and forming the slacked configuration on the portion of the movable region of the movable film.

In accordance with the invention described above, the recessed portions are formed on the portions on the surface of the substrate that become each of the movable regions of the movable film when the movable film supporting member is formed. Then, with the formation of the movable film on the entire surface of the substrate where the recessed portions are formed, it is easier to form the movable film having its slacked movable regions, that is, each region which is not supported by the movable film supporting member. In this way, with the formation of each movable region in the slacked configuration toward the liquid discharge head substrate, it becomes easier for the movable film to be displaced and transfer the bubbling energy efficiently. Particularly, with the performance of the isotropic etching for the formation of the recessed portions, the section of each of the recessed portions becomes substantially circular to make it possible to form the movable film to be easily displaceable. Also, it becomes possible to arrange the slacked portions of the movable film in the liquid flow paths in good precision.

Then, for the liquid discharge head structured in accordance with the present invention described above, the first liquid flow paths communicated with the discharge ports to supply the discharging liquid, and the second liquid flow paths to which the bubbling liquid is supplied are separated completely by the separation film. In the second liquid flow paths, the bubble creation regions are contained. Then, the movable film is displaced to the first liquid flow path side along with the development of each bubble in the bubble creation regions. With the pressure thus exerted, liquid is discharged for each of the discharge ports. Here, each movable region of the movable film, which is not supported by the movable film supporting member, is formed in the slacked configuration toward the liquid discharge head substrate. As a result, the displacement of the movable film becomes easier to transfer the bubbling energy efficiently.

In this respect, the term "upstream" and the term "downstream" are used as expression to indicate the direction of liquid flowing toward the discharge ports from the supply source of the liquid through the movable regions of the movable film or to indicate the direction in which this structure is formed.

DETAILED DESCRIPTION OF THE PREFERRED EMBODIMENTS

The present invention relates to a method for manufacturing a liquid discharge head that discharges liquid with the creation of bubbles by the application of thermal energy. In order to form such head, a movable separation film is provided to completely separates the liquid for bubbling use and the liquid for discharging use, in particular. Then, the discharging liquid is discharged by the movable separation film which is displaced to the discharge port side by the bubbling pressure exerted by the bubbling liquid.

Before describing a method for manufacturing a liquid discharge head of the kind, the description will be made of the displacement of the movable separation film mentioned in the preceding paragraph.

The Example of the Displacement Mode of the Movable Separation Film

Figure 10A:
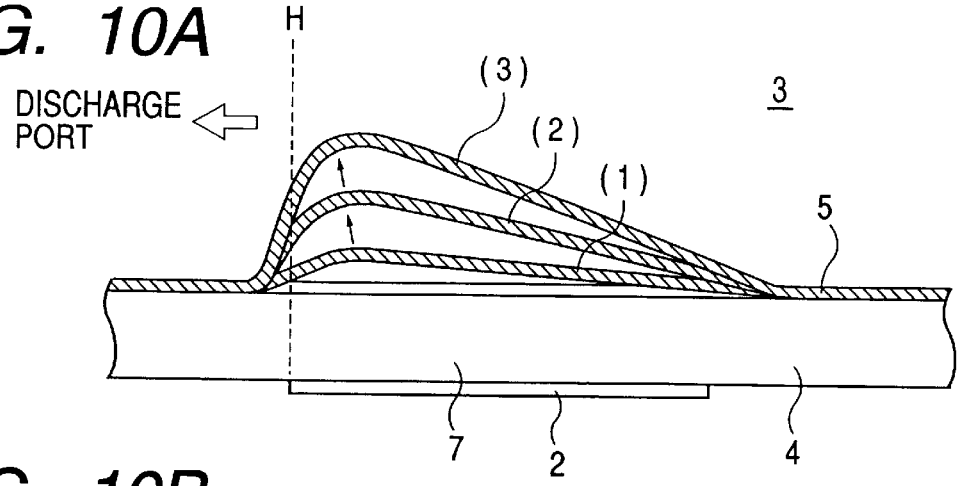
FIGS. 10A, 10B and 10C are cross-sectional views which illustrate the displacement process of the movable separation film at the time of the discharge operation of the liquid discharge head in accordance with the present invention, taken in the flow path direction.
Figure 10B:
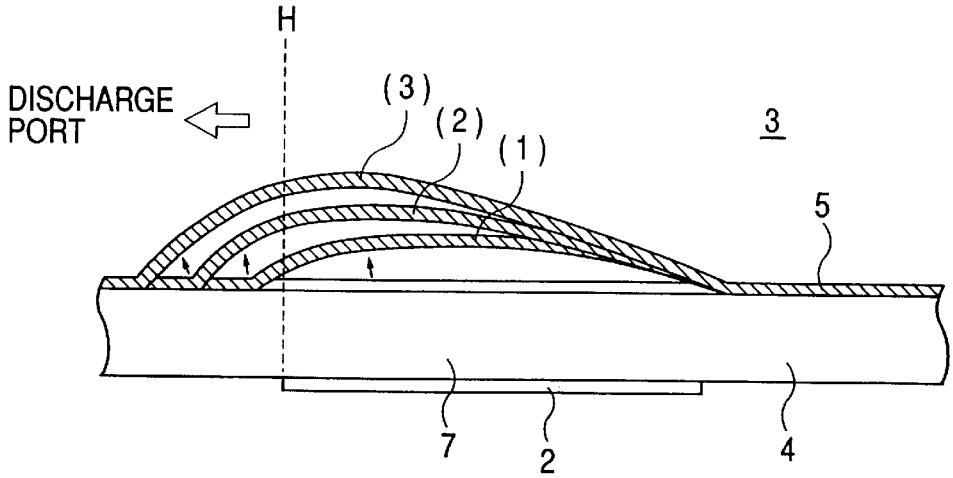
Figure 10C:
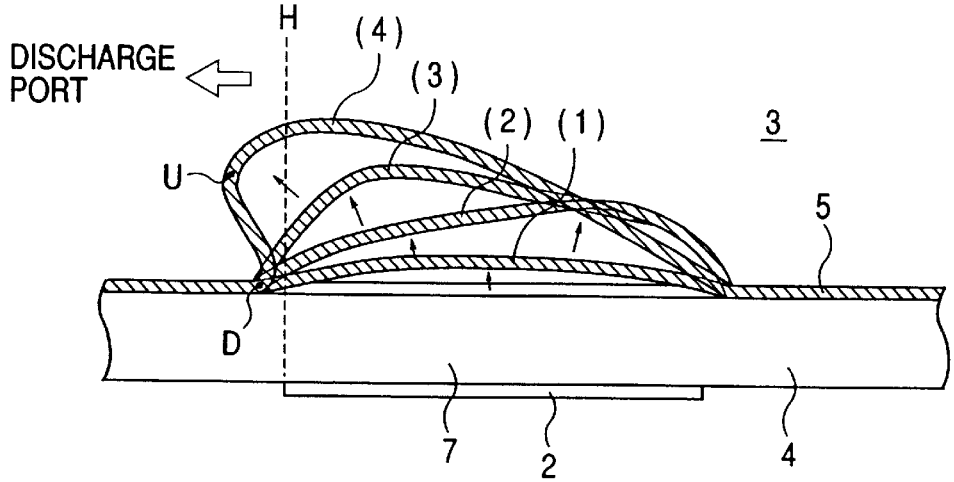

FIGS. 10A to 10C are cross-sectional views which illustrate the displacement process of the movable separation film at the time of discharge operation of the liquid discharge head of the present invention, taken in the flow path direction.

Here, the description will be made with a particular attention given to the movable range and the displacement of the movable separation film 5. Thus, the representation of the bubble and the discharge port of the first liquid flow path will be omitted in FIG. 10. However, for any one of the figures, the bubble creation area 7 is the vicinity of the projected area of a heat generating element 2 on the second liquid flow path 4 for the formation of the fundamental structure. Here, the second liquid flow path 4 and the first liquid flow path 3 are separated by the movable separation film 5 at all times, that is, these liquid flow paths are essentially separated from the initial stage and during the period of the displacement of the movable separation film. Also, with the end portion of the heat generating element on the downstream side (as indicated by dotted line H in FIGS. 10A to 10C) as the boundary, the discharge port is located on the downstream side, and the supply portion of the first liquid is located on the upstream side. In this respect, the term "upstream" and the term "downstream" are hereinafter meant to indicate the flow direction of the liquid in the flow path, which is observed from the central part of the movable region of the movable separation film.

In FIG. 10A, the movable separation film 5 is displaced from the initial state to those indicated at (1), (2), and (3) sequentially in that order, and the process is arranged so that the film on the downstream side is displaced greater than the upstream side from the initial state. Particularly, this process has an effect that the discharge efficiency is enhanced, and that the displacement on the downstream side acts upon the first liquid in the first liquid flow path 3 to move it so as to push the first liquid in the direction of the discharge port. As a result, it becomes possible to increase the discharge speeds. Here, in FIG. 10A, the above-mentioned movable ranges are substantially regular.

In FIG. 11B, the movable range of the movable separation film shifts or expands to the discharge port side as the movable separation film 5 is displaced in order of (1), (2), and (3). In this mode, the movable range is fixed on the upstream side. Here, as the downstream side of the movable separation film 5 is displaced greater than the upstream side, the discharge efficiency is made higher, because the development of the bubble itself takes place in the discharge port direction.

In FIG. 10C, the movable separation film 5 is displaced uniformly on the upstream and downstream sides or slightly greater on the upstream side than the initial state at (1) to the state indicated at (2). However, when the bubble is developed as shown at (3) and (4) in FIG. 10C, the downstream side is displaced greater than the upstream side. Then, the first liquid on the upper portion of the movable range is allowed to move in the discharge port direction. In this way, the discharge efficiency is enhanced, and at the same time, the discharge amount is increased.

Further, in the process at (4) in FIG. 10C, the point U where the movable separation film 5 resides is displaced on the discharge port side further than the point D where the movable separation film is positioned on the downstream side in the initial state. As a result, the discharge efficiency is further enhanced by the presence of this portion thus expanded to the discharge port side. Here, this particular configuration of the movable separation film in the displacement at this moment resembles the human nose. Therefore, this configuration is called the nose shape.

The liquid discharge method, which comprises the manufacturing processes described above, is implemented by the liquid discharge head manufactured by the method of the present invention. Each of the processes shown in FIGS. 10A to 10C is not necessarily independent from each other. In this respect, the processes that contain each of the components are construed to be those within the scope of the present invention. Also, the process that contains the nose shape is not confined to the one shown in FIG. 10C, but this particular process can also be introduced into those shown in FIGS. 10A and 10B. In this respect, the movable separation film 5 used for each process shown in FIGS. 10A to 10C is not necessarily made expandable. Also, the thickness of the movable separation film 5 represented in FIGS. 10A to 10C is not construed to signify any particular dimension to be adoptable.

Now, with reference to the accompanying drawings, the embodiments will be described in accordance with the present invention.

First Embodiment

Figure 1:
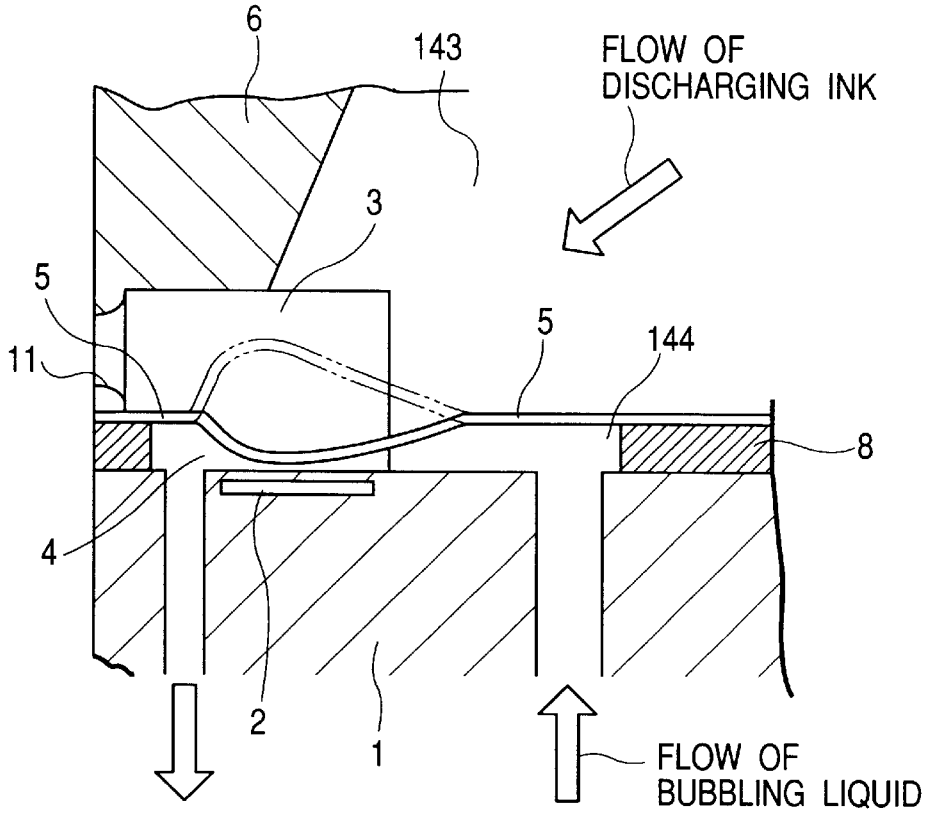
FIG. 1 is a cross-sectional view which shows a liquid discharge head in accordance with a first embodiment of the present invention, taken along in the flow path direction.
Figure 2:
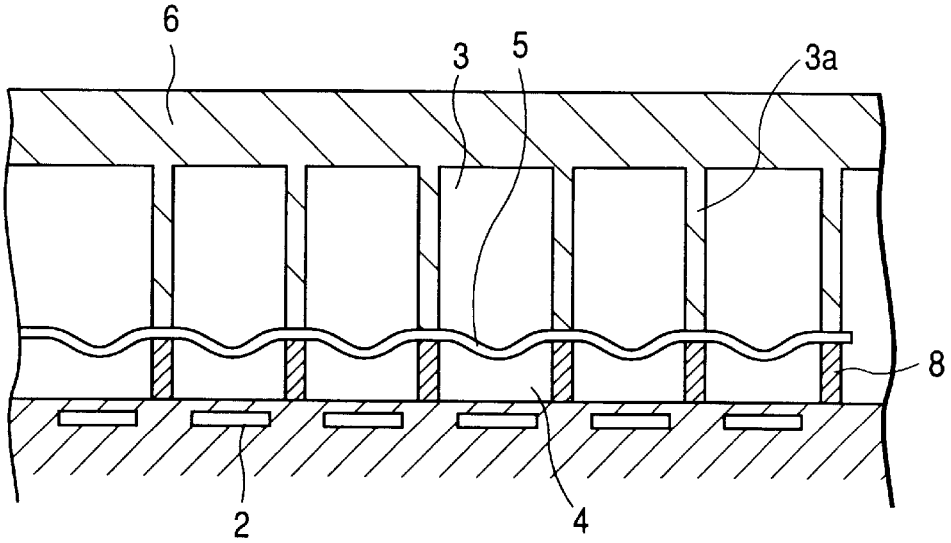
FIG. 2 is a vertically sectional view which shows the liquid discharge head represented in FIG. 1, taken along in the flow path direction.

FIG. 1 is a cross-sectional view which shows a liquid discharge head in accordance with a first embodiment of the present invention, taken along in the flow path direction. FIG. 2 is a vertically sectional view which shows the liquid discharge head represented in FIG. 1, taken along in the flow path direction.

In accordance with the present embodiment, the liquid discharge head comprises the substrate 1 for use of the liquid discharge head having on it heat generating elements 2 that provide thermal energy for liquid to create bubbles; the ceiling plate 6 provided with the discharge ports 11 for discharging liquid; and a movable film supporting member 8 arranged between the liquid discharge head substrate 1 and the ceiling plate 6 and bonded to both of them. Then, there is arranged an elastically movable separation film 5 for the movable film supporting member 8. With this movable separation film 5, the liquid flow paths are separated into the first liquid flow paths 3 and the second liquid flow paths 4.

Each of the second liquid flow paths 4 is the one which is formed between the liquid discharge head substrate 1, the movable film supporting member 8, and the movable separation film 5. The bubbling liquid is supplied to each of them from the supply path formed on the liquid discharge head substrate 1. Each of the first liquid flow paths 3 is the one which is formed between the movable separation film 5 and the ceiling plate 6. The bubbling liquid and the discharging liquid are completely separated by the movable separation film 5.

The first liquid flow paths 3 communicated with the discharge ports 11 are formed by bonding the liquid discharge head substrate 1 to the ceiling plate 6. In other words, the ceiling plate 6 roughly comprises the orifice plate having the discharge ports 11; a plurality of grooves that constitute a plurality of the first liquid flow paths 3; the recessed portion that constitutes the first common liquid chamber 143 communicated shareably with all the first liquid flow paths 3 and arranged to supply the liquid (discharging liquid) to each of the first liquid flow paths 3.

For the suitable material of the movable separation film 5, it is required to provide the heat resistance of approximately 300° C., as well as the elasticity with the excellent resistance to oil, resistance to solvent, and resistance to chemicals. For example, therefore, polyparaxylene or the like, which is used as the surface film of silicone rubber elastic member, is suitable because it has a good thin film formability when being applied by coating, deposition, or the like. With such material, the thin film can be formed by the application of the vapor deposition phase polymerization method. This material is elastic, while having an excellent contactness with silicon member. Also, fluororesin film or the like is suitable for the separation film used for the liquid discharge head of the present invention. After applying the water coating of fluororesin (FEP, PFA, PTFE, or the like), the film is formed by heat burning. The fluororesin is elastic, while having the excellent contactness with silicon member. Also, it may be possible to form the film by CVD method or the like using silicon nitride or silicon oxide.

Now, the description will be made of the method for manufacturing the liquid discharge head described above. FIGS. 3A to FIG. 5 are the process flows which illustrate the method for manufacturing such liquid discharge head.

Figure 3A:
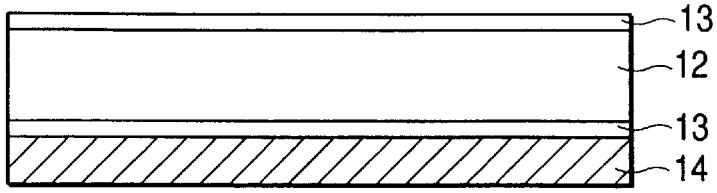
FIGS. 3A, 3B and 3C are views which illustrate the manufacturing process of the ceiling plate of the liquid discharge head shown in FIG. 1.
Figure 3B:
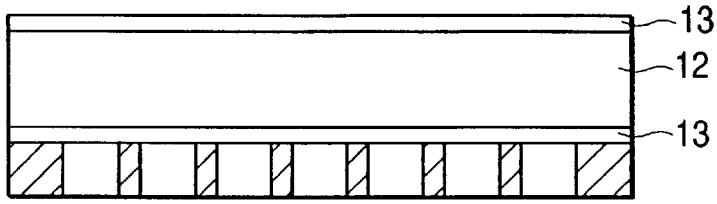
Figure 3C:
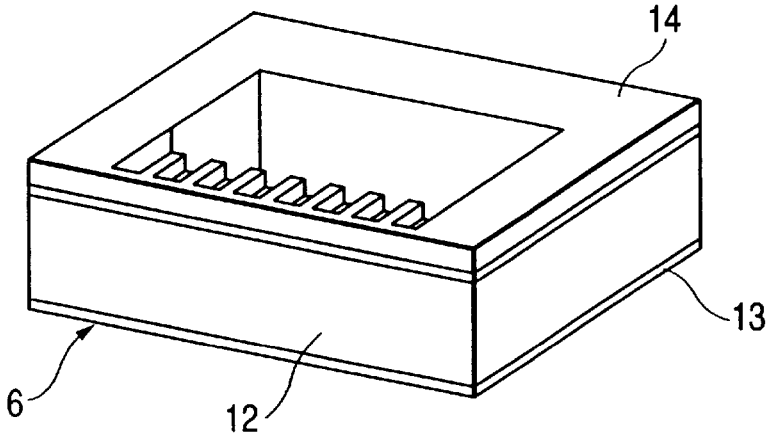

Here, with reference to FIGS. 3A to 3C, the manufacturing process of the ceiling plate 6 will be described.

At first, on both sides of a silicon wafer (Si substrate) 12, $SiO_2$ film 13 is formed by thermal oxidation in a film thickness of approximately 1 $\mu$m. Then, with a known method, such as photolithography, the portion that becomes the first common liquid chamber is patterned. On this patterned portion, SiN film 14 is formed by microwave CVD method in a film thickness of approximately 30 $\mu$m, which becomes the flow path walls 3*a* of the first liquid flow paths 3, and a part of the frame of the first common liquid chamber. In this respect, the gasses used for the microwave CVD for the formation of SiN film 14 are monosilane ($SiH_4$), nitrogen ($N_2$), and argon (Ar). In this respect, it may be possible to use a mixed gas in which disilane ($Si_2H_6$) and ammonia ($NH_3$) or the like are combined. In accordance with the present embodiment, the power of the microwave (2.45 GHz) is set at 1.5 [kW] to form the SiN film 14 at the gas flow rate of $SiH_4/N_2/Ar$=100/100/40 [sccm] in the high vacuum of 5 [mTorr]. Also, it may be possible to form the SiN film 14 by the CVD method using RF supply-source or the like with the component ratio other than the one mentioned above. Then, with the known method, such as photolithography, the orifice portion and the flow path portion are patterned, and etched into the trench structure by an etching apparatus using the dielectric bonding plasma. After that, using TMAH the penetration etching is given to the silicon wafer to complete the orifice-integrated ceiling plate 6 formed by silicon as shown in FIG. 1 and FIG. 2.

Figure 7:
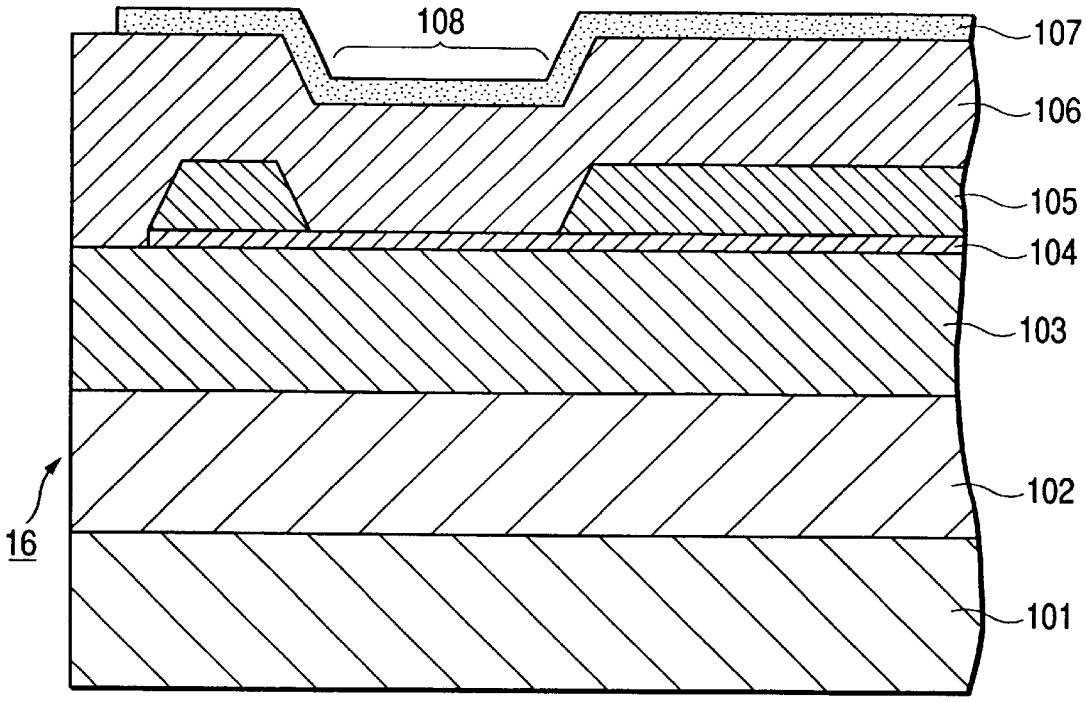
FIG. 7 is a cross-sectional view which illustrates the portion corresponding to the heat generating element of the liquid discharge head substrate.

Now, the description will be made of the elemental substrate that constitutes the above-mentioned liquid discharge head substrate. FIG. 7 is a cross-sectional view which illustrates the portion corresponding to the heat generating element (bubble creating area) of the liquid discharge head substrate 1. In FIG. 7, a reference numeral 101 designates a silicon substrate; 102, the thermal oxide film which serves as the heat accumulation layer; 103, the $SiO_2$ film or the $Si_2N_4$ film which serves as the interlayer film dually functioning as the heat accumulation layer; 104, the resistance layer; 105, Al, Al alloy wiring of Al—Si, Al—Cu, or the like; 106, $SiO_2$ film or $Si_2N_4$ film serving as the protection film; 107, the cavitation proof film that protects the protection film 106 from the chemical and physical shocks that follow the heat generation by the resistance layer 104. Also, a reference numeral 108 designates the heat activation portion of the resistance layer where no electrode wiring is formed.

These driving devices are formed on the Si substrate by the application of the semiconductor technologies and techniques, and then, the heat activation portion is further formed on one and the same substrate.

Figure 8:
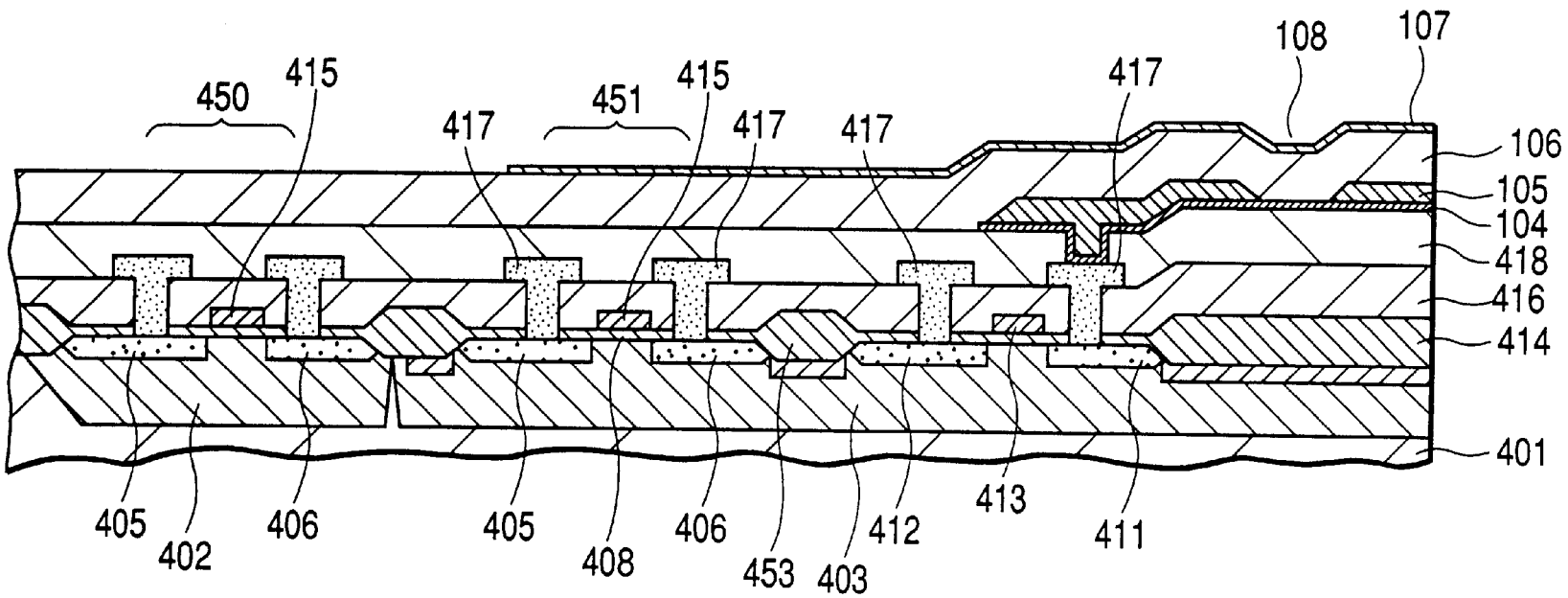
FIG. 8 is a cross-sectional view which shows schematically the main device of the liquid discharge head substrate which is cut vertically for representation.

FIG. 8 is a cross-sectional view which shows the main device schematically by cutting it vertically for representation.

The impurity installation such as ion plantation and its diffusion are conducted by means of the general MOS process in order to form the P-MOS 450 on the N type well region 402, and the N-MOS 451 on the P type well region 403, respectively, on the Si substrate 401 which is the P conductor. The P-MOS 450 and the N-MOS 451 comprise, among some other, the polysilicon gate wiring deposited by CVD method in a thickness of 4,000 Å or more and 5,000 Å or less through the gate insulation film 408 formed in a thickness of several hundreds of Å, and the source region 405 and the drain region 406 on which the N-type and P-type impurities are implanted. Thus, the C-MOS logic is structured by these P-MOS and N-MOS.

Also, the N-MOS transistor used for driving the devices comprises the drain region 411, the source region 412, and the gate wiring 413, and others formed on the P-well substrate by the process of the impurity implantation, diffusion, and others.

For the present embodiment, the description has been made of the structure that uses N-MOS transistor, but the transistor is not necessarily limited to it. Any type of transistor will do if only it should be capable of driving a plurality of heat generating elements individually, while such transistor has the functions whereby to achieve the structure as fine as the one described above.

Also, between each of the devices, there is formed an oxidized film separation region 453 in a thickness of 5,000 Å to 10,000 Å by the application of the field oxidation, hence separating each of the devices. This field oxidized film functions as the first layer of the heat accumulation layer under the heat activation portion 108.

After each of the elements is formed, the interlayer insulation film 416 is deposited by CVD method with the PSG film or the BPSG film in a thickness of approximately 7,000 Å. Then, after the interlayer insulation film thus deposited is smoothed by means of heat treatment, the wiring is executed through the contact hole using the Al electrodes 417, which serve as the first wiring layer. Subsequently, by the application of the plasma CVD method, the interlayer insulation film 418 formed with $SiO_2$ or the like is deposited in a thickness of 10,000 Å or more and 15,000 Å or less, and further, through the contact hole, the $TaND_{0.8,hex}$ film is formed by DC sputtering method in a thickness of approximately 1,000 Å as the resistance layer 104. After that, the second wiring layer of Al electrodes is formed as wiring to each of the heat generating elements.

As the protection film 106, the $So_2N_4$ film is formed by the plasma CVD in a thickness of 10,000 Å On the uppermost layer, the cavitation proof film 107 is deposited with Ta or the like in a thickness of 2,500 Å approximately.

Now, with reference to FIGS. 4A to 4F, the description will be made of the method for manufacturing the movable film supporting member 8 having the movable separation film 5 arranged for it. FIGS. 4A to 4F are views which illustrate the section of the movable film supporting member 8 in the discharge direction of liquid. The discharge ports are arranged on the left side in FIGS. 4A to 4F.

Figure 4A:
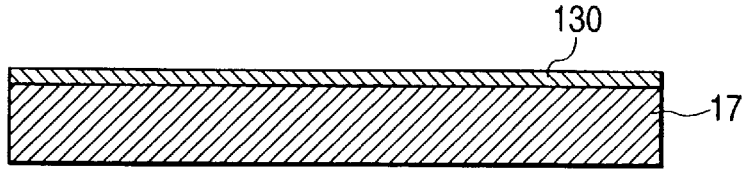
FIGS. 4A, 4B, 4C, 4D, 4E and 4F are views which illustrate the manufacturing process of the movable film supporting member of the liquid discharge head shown in FIG. 1.
Figure 4B:
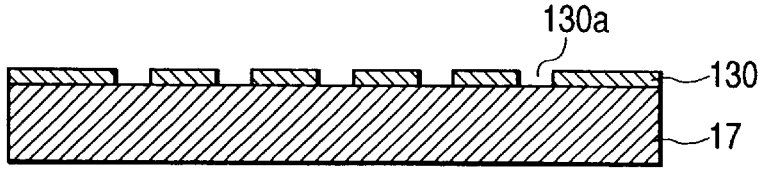
Figure 4C:
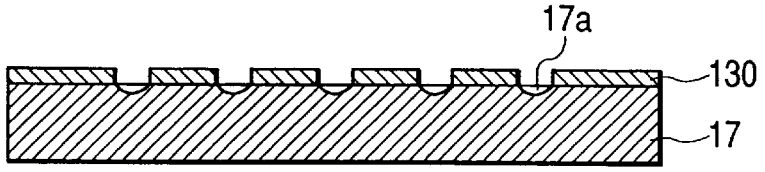

At first, photoresist 130 is coated on the silicon wafer 17 as the etching mask (FIG. 4A). Then, on the portion of this photoresist 130 corresponding to the movable portion of the movable separation film 5, each of the apertures 130*a* is formed by means of exposure and development in a size which is slightly smaller than the movable portion of the movable separation film 5 (FIG. 4B). Through this photoresist 130, the isotropic etching is performed on the silicon wafer 17 with the dry etching method using freon siries gas. Then, as shown in FIG. 4C, the recessed portions each having the circular section 17*a* are formed on the portions on the silicon wafer 17 each exposed by the apertures 130*a*, respectively.

Figure 4D:
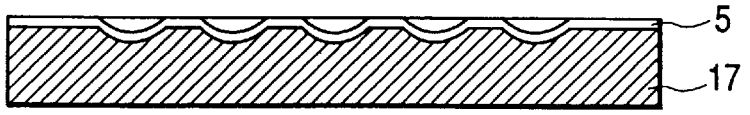

Then, the photoresist 130 remaining on the silicon ware 17 is removed by the application of plasma ashing or the like. Then, the movable separation film 5 is formed on the entire surface of the silicon wafer 17 (FIG. 4D). The movable separation film 5 may be formed with the silicon dioxide film by the application of thermal oxidation, silicon nitride film by the application of the plasma CVD, or formed by doping of phosphorous or boric acid, or by vapor deposition or coating of organic series film.

Figure 4E:
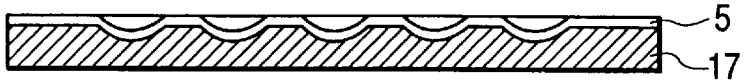
Figure 4F:
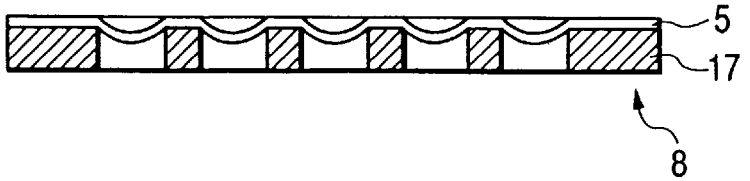
Figure 5:
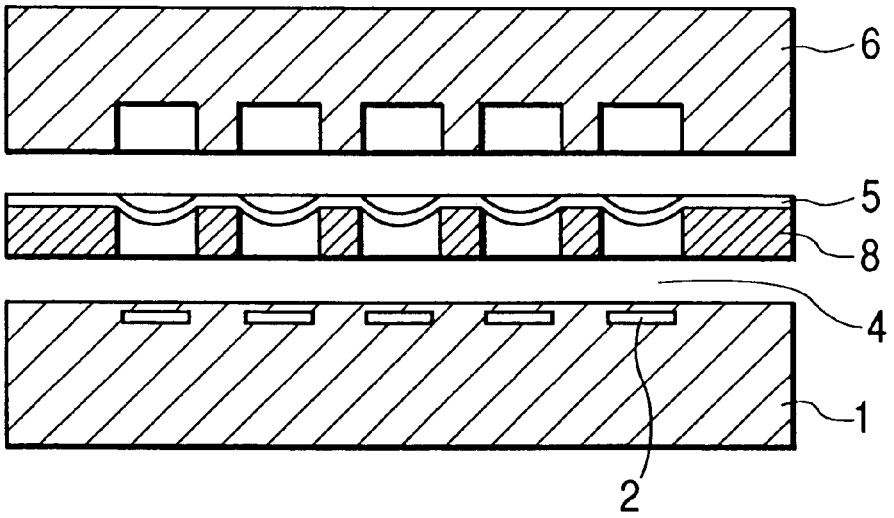
FIG. 5 is a view which illustrates the bonding of the ceiling plate, the movable film supporting member, and the liquid discharge head substrate of the liquid discharge head shown in FIG. 1.

The reverse side of the surface of the silicon wafer 17, where the movable separation film 5 is provided, is cut to a thickness equivalent to the height of the second liquid flow paths 4 by means of the CMP (chemical mechanical polishing) (FIG. 4E). Further, by the etching from the reverse side of the silicon wafer 17, the portion of the silicon wafer 17 that becomes the second liquid flow paths 4, that is, the portion corresponding to the aforesaid recessed portion is removed. Then, the movable film supporting member 8 having the movable separation film 5 on it is produced with each of the slacked portions in each of the second liquid flow paths 4, which also provides each of the movable regions for the movable separation film 5, respectively.

Here, the example is shown in which the movable film supporting member 8 is produced individually. However, after the movable separation film 5 is formed on the silicon wafer 17, the surface of the silicon wafer 17 where the movable separation film 5 is provided is bonded to the ceiling plate 6 in the state as shown in FIG. 4D. Then, the silicon wafer 17 may be cut to the specific thickness by means of the CMP. In this way, it becomes possible to prevent the damage that may be caused to the silicon wafer 17 when it is cut.

Now, the description will be made of the bonding of the ceiling plate 6 to the movable film supporting member 8, and the method for bonding the movable film supporting member 8 to the liquid discharge head substrate 1 as well.

As to the bonding of the ceiling plate 6 and the movable film supporting member 8, it is possible to bond them at the room temperature if the movable separation film 5 is formed by silicon nitride. For a cold bonding apparatus to be used, two vacuum chambers are needed. One of them is the preliminary chamber and the other is the pressure chamber, each keeping the vacuum at 1 to 10 Pa, respectively. Then, after the positioning adjustment is given to the ceiling plate 6 and the movable film supporting member 8 in the preliminary chamber, the ceiling plate and the movable film supporting member are carried to the pressure chamber where the bonding surface is activated by the energy particles irradiated by the saddle field type high-speed electron beams to the surface of the silicon nitride on the bonding portion. In this way, the ceiling plate and the movable film supporting member are bonded. In this case, it may be possible to heat them at a temperature of 200° C. or less or exert pressure on them in order to enhance the bonding strength thereof.

Also, if the movable separation film 5 is formed with organic resin, at least a part of the portion of the movable separation film 5, which is bonded to the ceiling plate 6, is removed so that silicon wafer 17 is exposed. In this way, the close contactness between the movable film supporting member 8 and the ceiling plate 6 is enhanced. Further, the surface treatment is given to the silicon wafer 17 by use of silane coupling agent or the like, and then, the material of the movable separation film 5 is formed. In this way, it is possible to enhance the close contactness between the movable separation film 5 and the silicon wafer 17.

For bonding the movable film supporting member 8 and the liquid discharge head substrate 1, it is possible to bond them at the room temperature after precisely positioning the second liquid flow paths provided for the movable film supporting member 8 and the heat generating elements 2 provided for the liquid discharge head substrate 1 using the cold bonding apparatus described above if the surface of the liquid discharge head substrate 1 is formed with silicon nitride.

Also, as the method for bonding the ceiling plate 6, the movable film supporting member 8, and the liquid discharge head substrate 1, besides the method that uses bonding at the room temperature as described above, it may be possible to bond them in such a manner that the thin film (3,000 Å) of water glass (sodium silicate) is coated on the bonding portion of the liquid discharge head substrate 1, or the movable film supporting member 8, or the ceiling plate 6, and after patterning, these are bonded by heating them at a temperature of 100° C. or that bonding agent is applied by means of transfer method or the like to either one of the liquid discharge head substrate 1, the movable film supporting member 8, and the ceiling plate 6, and then, to bond them by heating under pressure. In the above description, the structure is arranged so that the movable film supporting member 8 is bonded to the ceiling plate 6 in advance, and then, bonded further to the liquid discharge head substrate 1, but the structure may be arranged in such way that the flow path walls which become the second liquid flow paths are formed on the liquid discharge head substrate 1 in advance, and then, to bond the movable film supporting member 8 to the liquid discharge head substrate 1. Subsequently, then, the ceiling plate 6 is bonded.

Figure 6A:
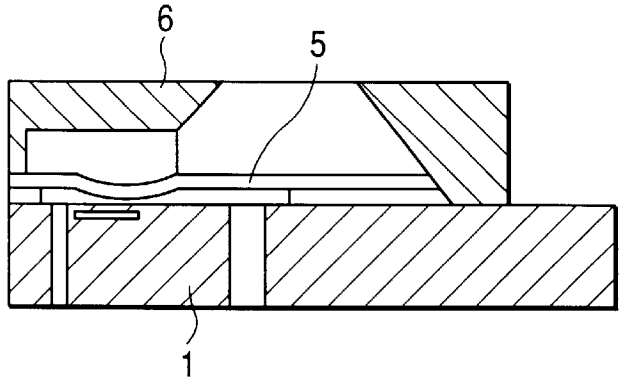
FIGS. 6A, 6B and 6C are views which illustrate the formation process of a discharge port on the ceiling plate.
Figure 6B:
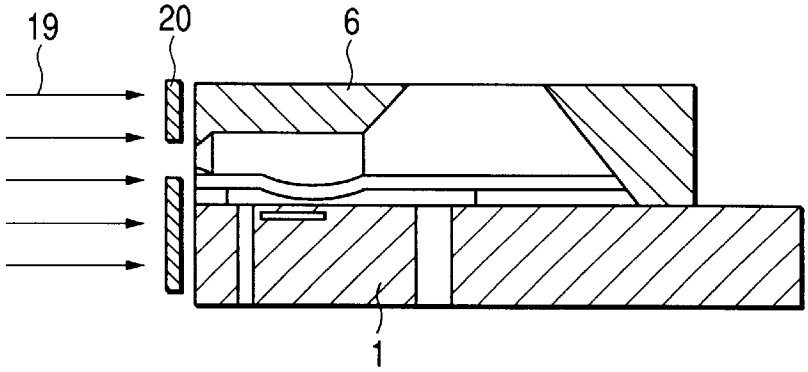
Figure 6C:
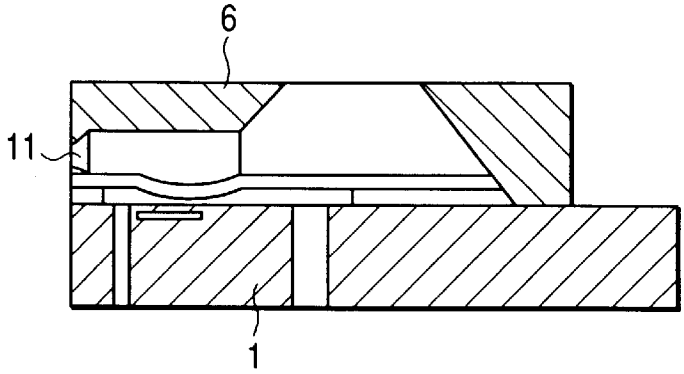

After that, as shown in FIGS. 6A to 6C, the orifice plate portion is processed by the irradiation of ion beams in vacuum with the mask 20 for the provision of the discharge ports 11. In this case, depending on the power of the ion beams, it becomes possible to process them in the reversed taper structure. Also, as the processing method of the discharge ports 11, the laser irradiation may be applicable with excimer laser at the room temperature under the normal atmospheric pressure.

In accordance with the present embodiment, each movable region of the movable separation film 5, that is, the portion, which is not supported by the movable film supporting member 8, is configured to be slacked toward the liquid discharge head substrate 1 of the liquid discharge head which is manufactured through each of the processing steps described above. Therefore, it becomes easier to displace the movable separation film 5 by means of the development of each bubble following the heat generated by each of the heat generating elements 2. As a result, the bubbling energy is transmitted efficiently so as to guide the discharging liquid residing in the first flow path 3 efficiently to the discharge port side. Also, the model itself used to form such slacked configuration of the movable separation film is adopted to constitute the movable film supporting member. As a result, the slacked portions of the movable separation film and the liquid flow paths can be positioned in higher precision to make it possible to enhance the operational reliability of the movable separation film significantly. Also, the movable film and the movable film supporting member are unitized as one body. As a result, the handling of the movable film becomes easier, leading to the significant reduction of the possibility that the movable film is damaged.

Second Embodiment

With the embodiment described above, it is possible to achieve the objectives of the present invention to provide a liquid discharge head capable of discharging various kinds of liquids with the adoption of a simple method of manufacture. However, the inventors hereof have acquired the knowledge that the efficiency of the liquid discharges can be further enhanced by devising the processing steps of such method of manufacture.

FIGS. 9A to 9I are views which illustrate the manufacturing processes of the movable film supporting member having the movable separation film, which makes it possible to enhance the liquid discharge efficiency still more. FIGS. 9A to 9I are cross-sectional views taken in the liquid discharge direction, and the discharge ports are arranged on the left side in FIGS. 9A to 9I.

Now, with reference to FIGS. 9A to 9I, the description will be made of a second embodiment in accordance with the present invention.

Figure 9A:
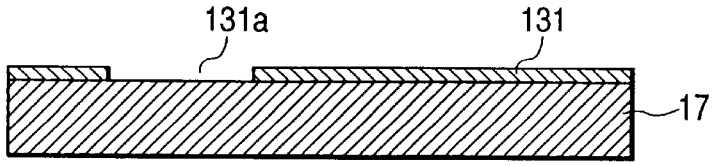
FIGS. 9A, 9B, 9C, 9D, 9E, 9F, 9G, 9H and 9I are views which illustrate the manufacturing process of the movable film supporting member of the liquid discharge head in accordance with a second embodiment of the present invention.
Figure 9B:
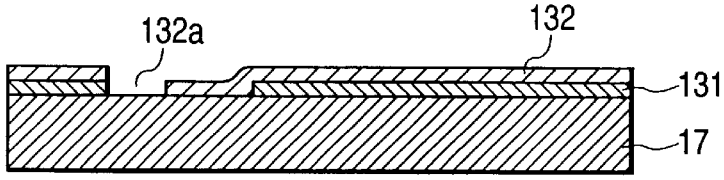

At first, with silicon dioxide, photoresist, or some other material, a first etching mask 131 is formed with the first opening 131*a* on the portion corresponding to the movable portion of the movable separation film 5 on the silicon wafer 17 (FIG. 9A). Then, with silicon nitride, silicon oxide, photoresist, or some other material, a second etching mask 132 is formed with a second opening 132*a* whose length is shorter than that of the first opening 131*a* in the liquid discharge direction on the first etching mask 131 (FIG. 9B). Here, the position of the second opening 132*a* is such that the second opening 132*a* is included in the first opening 131a, and that the central position of the second opening 132*a* is more on the discharge port side (on the left side in FIG. 9B) than the central position of the first opening 131*a*.

Figure 9C:
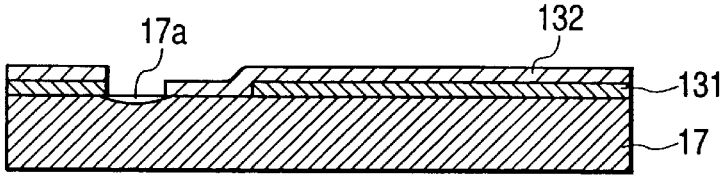
Figure 9D:
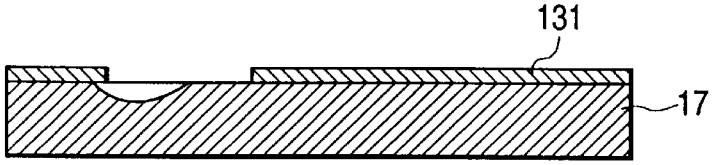
Figure 9E:
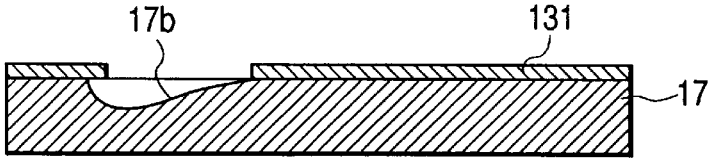

Then, by the same method as the first embodiment, the isotropic etching is performed on the surface of the silicon wafer 17 through the first etching mask 131 and the second etching mask 132 to form the small recessed portion 17*a* on the surface of the silicon wafer 17 (FIG. 9C). After that, with the second etching mask 132 and the silicon wafer 17, etching is continued at the ratio of the respective etching speeds. Then, the second etching mask 132 is removed to make the opening space wider (FIG. 9D). After that, the isotropic etching is further preformed on the surface of the silicon wafer 17 through the first etching mask 131. In this way, as shown in FIG. 9E, the recessed portion 17*b* is formed, which has become hollow grater on the discharge port side.

Figure 9F:
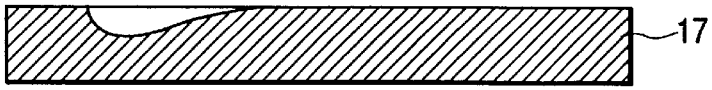
Figure 9G:
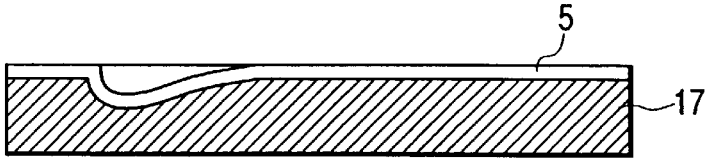
Figure 9H:
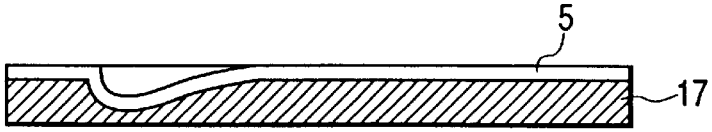
Figure 9I:
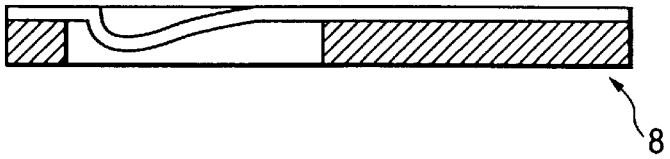

Subsequently, as in the first embodiment, the first etching mask 131 is removed (FIG. 9F). The movable separation film 5 is formed entirely on the surface of the silicon wafer 17 where the recessed portion 17*b* is made (FIG. 9G). The reverse side of the surface of the silicon wafer 17, where the movable separation film 5 is formed, is cut by means of the CMP to obtain the specific thickness of the silicon wafer 17 (FIG. 9H). Then, the portion that becomes the second liquid flow path 4 is etched from the reverse side of the silicon wafer 17 so that the movable film supporting member 8 is produced in such a manner, as shown in FIG. 9I, that the movable region of the movable separation film 5 is more slacked in the position closer to the discharge port side.

The second substrate 8 thus produced is bonded to the ceiling plate and the liquid discharge head substrate as in the first embodiment, thus forming the liquid discharge head. Then, it becomes possible to transfer the bubbling energy to the discharge port side more efficiently with the advantage of the configuration of the movable separation film 5 as described above.

Here, for the above embodiment, the description has been made of the mode in which the etching process is continuously executed by use of the first and second etching masks having almost the same etching speed. However, if the etching speed ratio is sufficiently different between the material of the first etching mask 131 and the material of the second etching mask 132, only the second etching mask is selectively removed after the isotropic etching has been performed on the silicon wafer 17 through the first and second etching masks. After that, it may be possible to form the configuration of the recessed portion 17*b* as shown above by executing the isotropic etching on the silicon wafer 17 only through the first etching mask 131.

As described above, in accordance with the present invention, the recessed portion is formed on the surface portion of the substrate that becomes the movable region of the movable film when the movable film supporting member is formed to support the movable film. Then, the movable film is formed on the entire surface of the substrate having such recessed portion is produced, thus making it easier to form the movable film whose movable region is slacked. As a result, it becomes possible to transfer the bubbling energy efficiently, and to guide the discharging liquid residing in the first liquid flow path 3 to the discharge port side efficiently. Also, the model itself used to form such slacked configuration of the movable separation film is adopted to constitute the movable film supporting member. Therefore, the slacked portions of the movable separation film and the liquid flow paths can be positioned in higher precision to make it possible to enhance the operational reliability of the movable separation film significantly. Also, the movable film and the movable film supporting member are unitized as one body. As a result, the handling of the movable film becomes easier, leading to the significant reduction of the possibility that the movable film is damaged. In this case, the recessed portion is formed by means of the isotropic etching to form the movable film easily displaceable. Thus, the liquid discharge head manufactured by the method of manufacture of the present invention makes it possible to form each of the movable regions of the movable film that separates each of the first liquid flow paths and second liquid flow paths in the slacked configuration toward the liquid discharge head substrate. As a result, it becomes possible to transfer the bubbling energy to the discharge port side efficiently, and obtain the higher power of discharges. Also, with the provision of the movable film, the discharging liquid and bubbling liquid are separated completely to make it possible to select freely the discharge liquid from among those currently available, irrespective of the viscosity and composition thereof, and further, despite the thermal influence exerted by the heat generating elements.

With the liquid discharge head produced by the method of manufacture of the present invention (embodiments), which is structured as described above, it is made possible to discharge the discharging liquid, while using the discharging and bubbling liquids as different liquids. Therefore, the highly viscous liquid, such as polyethylene glycol, which does not bubble sufficiently even by the application of heat with the resultant insufficient discharging power, is now made dischargeable in good condition if this liquid is supplied to the first liquid flow paths 3, while the liquid (a mixture of ethanol:water=4:6 in approximately 1 to 2 cp or the like), which bubbles in good condition, is supplied to the second liquid flow paths 4 as the bubbling liquid.

Also, with the selection of the liquid, which does not cause any deposition such as burnt particles on the surface of the heat generating elements 2 when being heated, as the bubbling liquid to be used, it becomes possible to stabilize bubbling and perform discharges in good condition.

Further, with the liquid discharge head produced by the method of manufacture of the present invention, which is structured as described above, it is possible to demonstrate the aforesaid effects and discharge the highly viscous liquid or the like with a higher discharge efficiency and discharge power.

Also, even when the liquid whose property is weak against heat is used, such liquid can be discharged with the higher discharge efficiency and discharge power as described above without damaging it thermally if this particular liquid is supplied to the first liquid flow paths 3 as the discharging liquid, while the liquid, which bubbles in good condition but does not change its properties easily when being heated, is supplied to the second liquid flow paths 4.

In addition, with the arrangement of the movable separation film 5, it becomes possible to discharge liquid with a higher discharge power and efficiency at a higher speed than the conventional liquid jet apparatus. As the bubbling liquid, it should be good enough if only any one of those having the above-mentioned properties. More specifically, the following ones may be adoptable for the purpose:

Methanol, ethanol, n-propanol, isopropanol, n-hexane, n-heptane, n-octane, toluene, xylene, methylene dichloride, trichrene, Freon TF, Freon BF, ethylether, dioxane, cyclohexane, methyl acetate, ethyl acetate, acetone, methylethyl ketone, water, or the like, and the mixture thereof.

As the discharging liquid, it is possible to use various ones without regard to the presence or absence of its bobbling capability or its thermal properties. Also, the liquid whose bubbling capability is too low to be used for discharging, the liquid whose property is easily modified or deteriorated by the application of heat, the liquid whose viscosity is too high, or the like, which cannot be easily discharged conventionally, can also be utilized.

However, it is desirable to use the liquid which does not impede the discharging, bubbling, or the operation of the movable separation film by the discharging liquid itself due to its own property or by its reaction with the bubbling liquid.

It is also possible to use highly viscous ink or the like as the discharging liquid for use of recording.

As the other discharging liquid, it may be possible to utilize the liquid, such as medicine or perfume, which is weak against heat.

In this respect, the recording is performed in the combination of the liquids whose compositions are given below as the bubbling liquid and discharging liquid. As a result, it is possible to obtain the recorded objects in high quality using the liquid whose viscosity is as high as 150 cp, which has not been easily discharged by the conventional liquid jet apparatus, not to mention the liquid whose viscosity is ten and several pc.

| | | |
|---|---|---|
| Bubbling liquid 1 | ethanol | 40 wt % |
| | water | 60 wt % |

-continued

| | | |
|---|---|---|
| Bubbling liquid 2 | water | 100 wt % |
| Bubbling liquid 3 | isopropyl alcohol | 10 wt % |
| | water | 90 wt % |
| Discharging liquid (pigment ink about 15 cp) styrene-acrylic acid-ethyl acrylate copolymer separation agent (oxidation 140 weight average molecular weight 8,000) | carbon black | 5 wt % |
| | monoethanol amine | 0.25 wt % |
| | glycerin | 6.9 wt % |
| | chiodiglycol | 5 wt % |
| | ethanol | 3 wt % |
| | water | 16.75 wt % |
| Discharging liquid 2 (55 cp) | polyethylene glycol 200 | 100 wt % |
| Discharging liquid 3 (150 cp) | polyethylene glycol 600 | 100 wt % |

Now, as described earlier, the discharge speed is slower when the liquid, which is not easily dischargeable, is discharged in accordance with the conventional art. Therefore, the fluctuation of discharge orientations tends to be emphasized to degrade the dot impact accuracy on a recording sheet. Also, the fluctuation of discharge amount takes place due to the unstable discharges. As a result, it is not easy to obtain high quality images. However, with structure formed in accordance with the present embodiment, the bubbles are created by use of the bubbling liquid sufficiently and stably. With this advantage, the impact accuracy of the droplets is improved, and at the same time, the discharge amount of ink is stabilized, hence making it possible to improve the quality of recorded images significantly.

Liquid Discharge Apparatus

Figure 11:
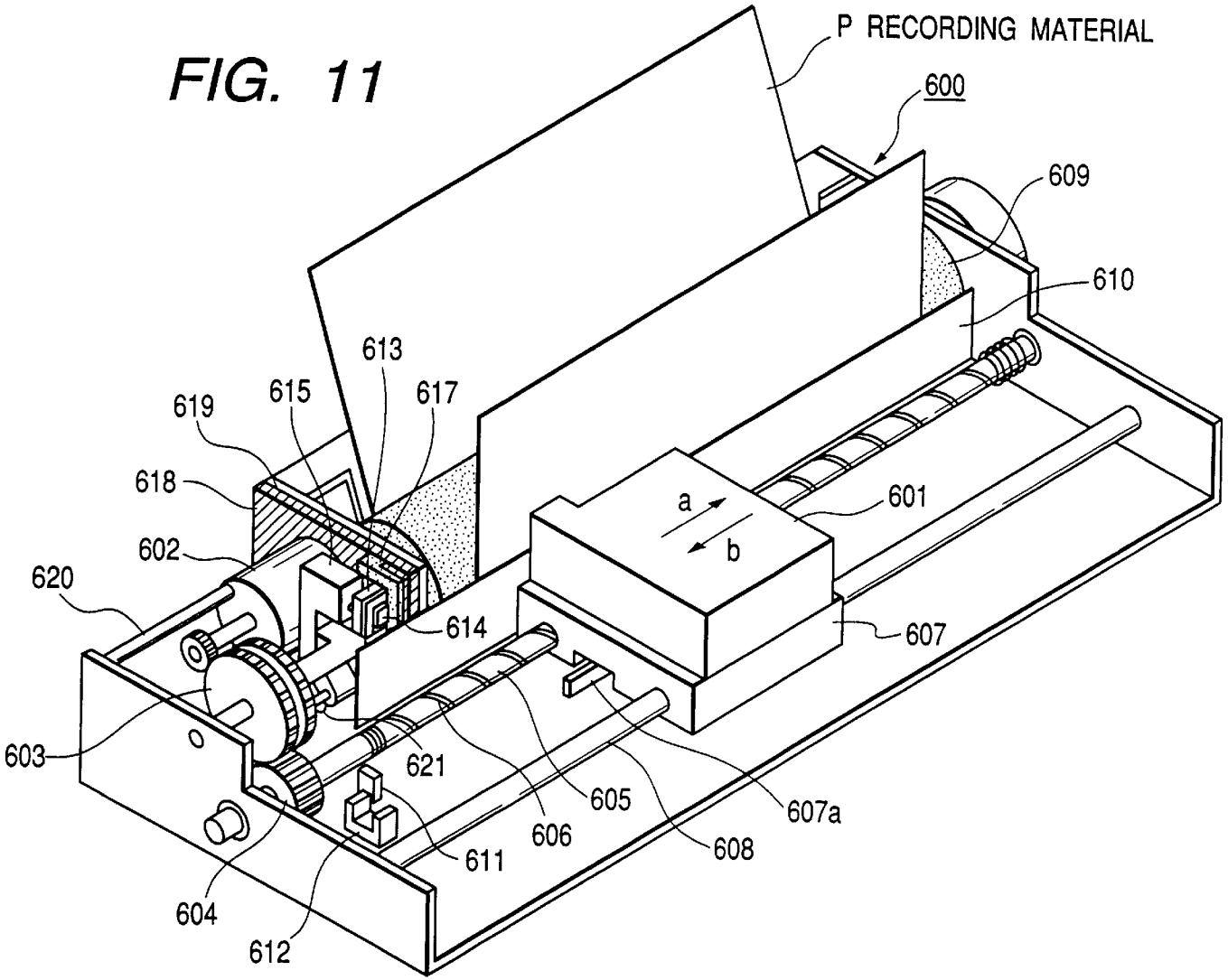
FIG. 11 is a perspective view which schematically shows one example of the ink jet recording apparatus which is provided with the liquid discharge head of the present invention.

FIG. 11 is a perspective view which schematically shows one example of the ink jet recording apparatus to which the liquid discharge head of the present embodiment is applicable. In FIG. 11, a reference numeral designates the head cartridge which is integrally formed with the ink jet recording head of the present embodiment and an ink tank. This head cartridge 601 is mounted on the carriage 607 which engages with the spiral groove 606 of the lead screw 605 that rotates through the power transmission gears 603 and 604 interlocked with the regular and reverse rotations of the driving motor 602. By the driving power of the driving motor 602, the head cartridge 601 reciprocates together with the carriage 607 along the guide 608 in the directions indicated by arrows a and b. The sheet pressure plate 610 for use of the printing sheet P, which is carried on the platen 609 by use of the recording medium supply device (not shown), is arranged to press the printing sheet P to the platen 609 over the traveling direction of the carriage.

In the vicinity of one end of the lead screw 605, the photocouplers 611 and 612 are arranged, which constitute home position detecting means that recognizes the presence of the lever 607*a* of the carriage 607 within this region to switch over the rotational directions of the driving motor 602, among some other operations.

In FIG. 11, a reference numeral 613 designates the supporting member 613 which supports the cap member 614 that covers the front end where the discharge ports are provided for the ink jet head 601. Also, a reference numeral 615 designates ink suction means provided for sucking ink residing in the interior of the cap member 614 by the idle discharges or the like from the head 601. With this ink suction means 615, the suction recovery of the head 601 is performed through the aperture in the cap member 614. A reference numeral 617 designates a cleaning blade, and 618, a member that moves the blade forward and backward (in the direction orthogonal to the traveling direction of the aforesaid carriage 607). The blade 617 and this member 618 are supported by the main body supporting member 619. The blade 617 is not necessarily limited to this mode. The blade in some other known modes may be adoptable. Here, a reference numeral 620 designates a lever 620 provided for initiating suction when operating a suction recover, which moves along the movement of the cam 621 which engages with the carriage 607. The movement thereof is controlled by known transmission means, such as a clutch, that switches over the driving power of the driving motor 602. The ink jet recording controlling unit (not shown in FIG. 11) is installed on the main body of the ink jet recording apparatus to supply signals to the heat generating elements arranged for the head cartridge 601 or execute the driving controls of each of the mechanisms described above.

The ink jet recording apparatus 600 thus structured performs recording on a printing sheet P, which is carried on the platen 609 by means of the recording medium supply device (not shown), while the head 601 reciprocates on the entire width of the printing sheet P.

What is claimed is:

1. A method for manufacturing a liquid discharge head provided with a discharge port for discharging a liquid droplet; a first liquid flow path for supplying discharging liquid to said discharge port; a second liquid flow path for bubbling liquid supplied thereto; a heat generating element for the formation of a bubble creation region arranged for said second liquid flow path; a movable film supporting member for supporting a movable film separating said first liquid flow path and said bubble creation region completely, and being displaceable by a bubble created on said heat generating element; and discharging a liquid droplet from said discharge port by use of thermal energy provided by said heat generating element, comprising the following steps of:

forming said movable film supporting member;

forming on a surface of a substrate becoming said movable film supporting member a recessed portion corresponding to the movable region of said movable film;

providing a material becoming said movable film on the entire surface of the substrate having said recessed portion provided thereon;

removing the portion including said movable region on said substrate from the reverse side of the substrate having said movable film provided thereon; and forming a slacked configuration on the portion of said movable region of said movable film prior to displacement by said bubble.

2. A method for manufacturing a liquid discharge head according to claim 1, wherein said step of forming the recessed portion on the substrate of said movable film supporting member is performed by isotropic etching.

3. A method for manufacturing a liquid discharge head according to claim 2, wherein said isotropic etching is performed by use of a plurality of masks to enable the downstream side to be depressed more than the upstream side in the liquid flow direction in said first liquid flow path.

4. A method for manufacturing a liquid discharge head according to claim 3, wherein a plurality of etching masks are laminated on the surface of said substrate to include an opening on the upper layer in an opening on the lower layer, respectively, and the center of said upper layer opening is positioned more on the downstream side than the center of said lower layer opening, and said substrate is isotropically etched through said plurality of etching masks, and said recessed portion is formed by use of a difference in etching speed of the etching masks and the substrate.

5. A method for manufacturing a liquid discharge head according to claim 3, wherein a plurality of etching masks are laminated on the surface of said substrate to include an opening on the upper layer in an opening on the lower layer, respectively, and the center of said upper layer opening is positioned more on the downstream side than the center of said lower layer opening, and after said isotropic etching is performed, said recessed portions are formed by repeating the step of removing the etching mask on the uppermost layer of said etching masks by the number of said etching masks.

6. A method for manufacturing a liquid discharge head according to claim 1, wherein said movable film is formed by a material having silicon as the main component thereof.

7. A method for manufacturing a liquid discharge head according to claim 1, wherein said movable film is formed by resin.

8. A method for manufacturing a liquid discharge head according to claim 7, wherein a silane coupling process is performed on the surface of said substrate before said movable film is formed on said substrate.

9. A method for manufacturing a liquid discharge head according to claim 1, further comprising the steps of:

forming a ceiling plate having said discharge port and said first liquid flow path; and forming said second liquid flow path between said movable film supporting member and said liquid discharge head substrate by bonding said ceiling plate, said movable film supporting member, and said liquid discharge head substrate in that order.

10. A method for manufacturing a liquid discharge head according to claim 9, wherein said movable film is formed of resin and the bonding portion of said movable film of said movable film supporting member to said ceiling plate or to said liquid discharge head substrate is partly removed.

* * * * *

UNITED STATES PATENT AND TRADEMARK OFFICE

CERTIFICATE OF CORRECTION

PATENT NO. : 6,436,301 B1
DATED : August 20, 2002
INVENTOR(S) : Hiroki et al.

It is certified that error appears in the above-identified patent and that said Letters Patent is hereby corrected as shown below:

Title page,
Item [56], OTHER PUBLICATIONS, "(wth" should read -- (with --.

Column 1,
Line 45, "a facsimile" should read -- or a facsimile --; and
Line 48, "the-conventional" should read -- the conventional --.

Column 2,
Line 21, "non" should read -- none --.

Column 3,
Line 66, "expression" should read -- expressions --.

Column 4,
Line 53, "head," should read -- a head, --; and
Line 54, "separates" should read -- separate --.

Column 5,
Line 38, "11B," should read -- 10B, --.

Column 8,
Line 46, "$TaND_{0.8,hex}$" should read -- $TaN_{0.8,hex}$ --;
Line 50, "$So_2N_4$" should read -- $Si_2N_4$ --; and
Line 51, "Å On" should read -- Å. On --.

UNITED STATES PATENT AND TRADEMARK OFFICE

CERTIFICATE OF CORRECTION

PATENT NO. : 6,436,301 B1
DATED : August 20, 2002
INVENTOR(S) : Hiroki et al.

It is certified that error appears in the above-identified patent and that said Letters Patent is hereby corrected as shown below:

Column 10,
Line 33, “such way” should read -- such a way --.

Signed and Sealed this

Thirteenth Day of May, 2003

JAMES E. ROGAN
*Director of the United States Patent and Trademark Office*